United States Patent [19]

Bayer

[11] Patent Number: 4,569,154

[45] Date of Patent: Feb. 11, 1986

[54] THERMALLY INSULATING WINDOW ASSEMBLY

[75] Inventor: Michael S. Bayer, South Euclid, Ohio

[73] Assignee: Thermal-Barrier Products, Inc., Bedford, Ohio

[21] Appl. No.: 675,208

[22] Filed: Nov. 27, 1984

Related U.S. Application Data

[63] Continuation-in-part of Ser. No. 555,684, Nov. 28, 1983.

[51] Int. Cl.[4] ..... E06B 1/12

[52] U.S. Cl. ..... 49/504; 49/DIG. 1; 49/161

[58] Field of Search ..... 49/504, 505, 177, 174, 49/175, 158, 161, DIG. 1, DIG. 2; 52/213, 214

[56] References Cited

U.S. PATENT DOCUMENTS

| | | | |
|---|---|---|---|
| 2,614,296 | 10/1952 | Van Der Pelen et al. | 49/177 X |
| 3,208,564 | 9/1965 | Sitterly | 52/213 |
| 3,420,001 | 1/1969 | Raymon | 49/407 |
| 3,750,334 | 8/1973 | Slaybaugh | 49/177 |
| 4,151,682 | 5/1979 | Schmidt | 49/504 X |
| 4,222,201 | 9/1980 | Yanessa | 49/174 X |
| 4,281,481 | 8/1981 | Wendt | 49/504 |
| 4,299,060 | 11/1981 | Tippmann | 49/504 |
| 4,333,283 | 6/1982 | Ebata | 49/63 X |
| 4,399,636 | 8/1983 | Blackwell | 49/425 X |
| 4,483,099 | 11/1984 | Schmidt | 49/63 |

FOREIGN PATENT DOCUMENTS 1388819 3/1975 United Kingdom .

*Primary Examiner*—Philip C. Kannan

*Attorney, Agent, or Firm*—Renner, Otto, Boisselle & Lyon

[57] ABSTRACT

A window assembly is formed of an inside facing vinyl extrusion portion and an outside facing aluminum extrusion portion which are interconnected by resilient snap-fit barb-like connectors integral with each extrusion, thus forming a composite type construction. The metal outside facing portion provides strength, durability and weather resistance; while the vinyl inside facing portion improves thermal insulation characteristics, reduces or eliminates sweating, and enables color, pattern, and other design aesthetics conveniently to be included in the window assembly. The window assembly may be virtually any type, such as the fixed light (window glass) type, sliding type, double hung type, picture type, etc.

13 Claims, 18 Drawing Figures

THERMALLY INSULATING WINDOW ASSEMBLY

CROSS REFERENCE TO RELATED APPLICATION

This application is a continuation in part of copending, commonly assigned, U.S. patent application Ser. No. 555,684, filed Nov. 28, 1983.

FIELD OF THE INVENTION

The present invention relates to window assemblies, and in particular to window assemblies employing a metal portion and a plastic portion, for example, in the form of respective extrusions, which are joined ordinarily to present one of those portions to one environment and the other of those portions to another environment. In one example, the metal portion faces the outside of a building and the vinyl portion faces the inside of the building. The window assemblies may be of various types including, for example, fixed light, double hung, sliding, and so on.

BACKGROUND OF THE INVENTION

In the past various parts, such as frame members, stile members, jamb members, etc. of a window have been made of metal with a vinyl or plastic layer or veneer of material applied to cover the metal for various purposes, such as aestetics and thermal insulation. Several disadvantages to such an approach include the ease with which the plastic or vinyl layer may be damaged and the relatively small amount of thermal insulation characteristics achieved thereby.

The present invention is described in detail herein with respect to a sliding window. However, it will be appreciated that the invention may be employed in other types of windows, such as double hung windows, windows with fixed glass or lights, and other types of windows. Moreover, the preferred material employed in the present invention is described herein as a vinyl material; alternatively, material may be identified equivalently as plastic material; in any event, the invention is intended to cover all vinyl, plastic and other materials that are non-metal and, thus, are relatively thermally nonconductive compared to the relatively high thermal conduction of metal. In the following description, reference is also made to aluminmum as the preferred metal portion of the window; it will be appreciated that other types of metal materials may be employed consistent with the invention. Still further, various portions of the window assembly of the invention are described below as being extrusions, i.e., a part being formed by extruding of material; however, it will be appreciated that the various parts of the invention may be formed or manufactured using techniques other than extusion.

Metal windows have various advantages over wood windows; for example, metal windows do not warp and can be made of materials that are extremely durable, weather resistant, etc. However, there are a number of disadvantages to metal windows, for example, the relatively high thermal conductivity thereof and, thus, the poor insulation characteristics, sweating or condensation of moisture on the metal, and the difficulty of providing aestetically pleasing appearance especially on the inside, i.e., the portion exposed in a room of a building.

The prior art includes sliding windows with sashes which slide between opened and closed positions in parallel tracks. Generally, such windows include two sashes which slide in parallel, offset tracks. Weatherstripping seals the spaces between the sashes and between the sashes and tracks. Although traditional window assemblies (including sashes and tracks) have been made of wood, modern manufacturing techniques and materials have made it possible to manufacture these components from metal or plastics, or a combination, and such combined materials have thermal, aesthetic and economic advantages. Usually the prior combination of metal and plastic windows have simply included a veneer of plastic glued or similarly bonded or adhered to the metal at an interface surface.

SUMMARY OF THE INVENTION

As used herein, metal window or metal window portion means the metal used to form the frame and/or sash of the window assembly, such as generally linear metal or elongate metal extrusions four or more of which ordinarily may be assembled say in quadrilateral relation to form the window frame or sash. Similarly, plastic or vinyl window portion means the plastic, vinyl or like material linear or elongate extrusions which are intended to be joined with the metal window portions in the window assembly. The window outside ordinarily means that portion exposed to the outside environment, e.g. exposed to the weather, and the window inside ordinarily means that portion exposed indoors, e.g. inside a room of a building. Plastic and vinyl may be used interchangeably and equivalently herein and are intended to mean materials of plastic, vinyl, polyvinyl chloride (PVC) and other similar materials which have charactistics of plastic and vinyl, such as straength, generally minimal thermal conductivity (especially compared to that of metal), resiliency, weight, durability, extrudability, and so on.

The present invention overcomes the difficulties of the prior art window assemblies by providing an improved assemblage of metal and plastic members to form the window frame and/or sash in order to achieve adantages of both materials, especially including minimizing of thermal conductivity and sweating, improving and facilitating versatility of aesthetics on the inside, and facilitating inside cleaning of the fame and sash members.

The invention also relates to a mechanism for coupling metal and plastic members using interconnecting interlocking barbs, darts or arrows, used equivalently herein.

Thus, rather than having a so-called clad window in which a veneer type approach is taken, the present invention uniquely mechanically locks two separate pieces, such as frame, sash, stile, rail, parts of a window, one piece of which is vinyl and one piece of which is aluminum (although if desired other dissimilar materials such as aluminum and wood or wood and plastic could be used) in order to complete the particular member of the window herein. The result is a positive lock function securing the parts together, thermal insulation properties, aestetic value, and window strength, all accomplished by the totality of the combination.

The invention, then, comprises the features hereinafter particularly pointed out and distinctly claimed in the claims. The following specification, taken together with the appended drawings, describes but a few of the various ways in which the invention may be carried out.

DESCRIPTION OF PREFERRED EMBODIMENTS

Figure 1:
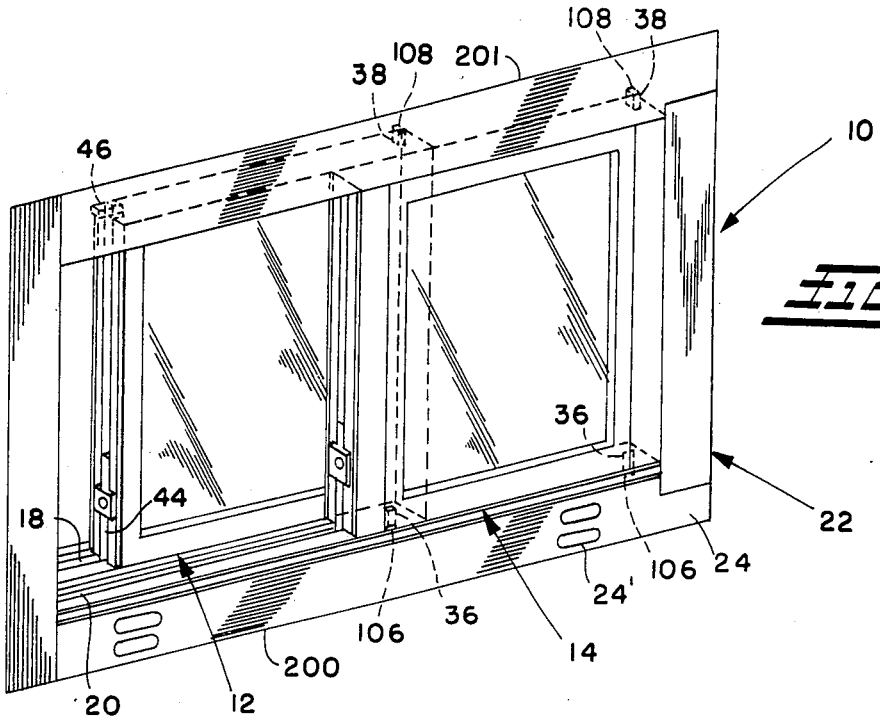
FIG. 1 is a perspective illustration of a horizontally sliding window embodying the features of the present invention and viewed from the outside.
Figure 2:
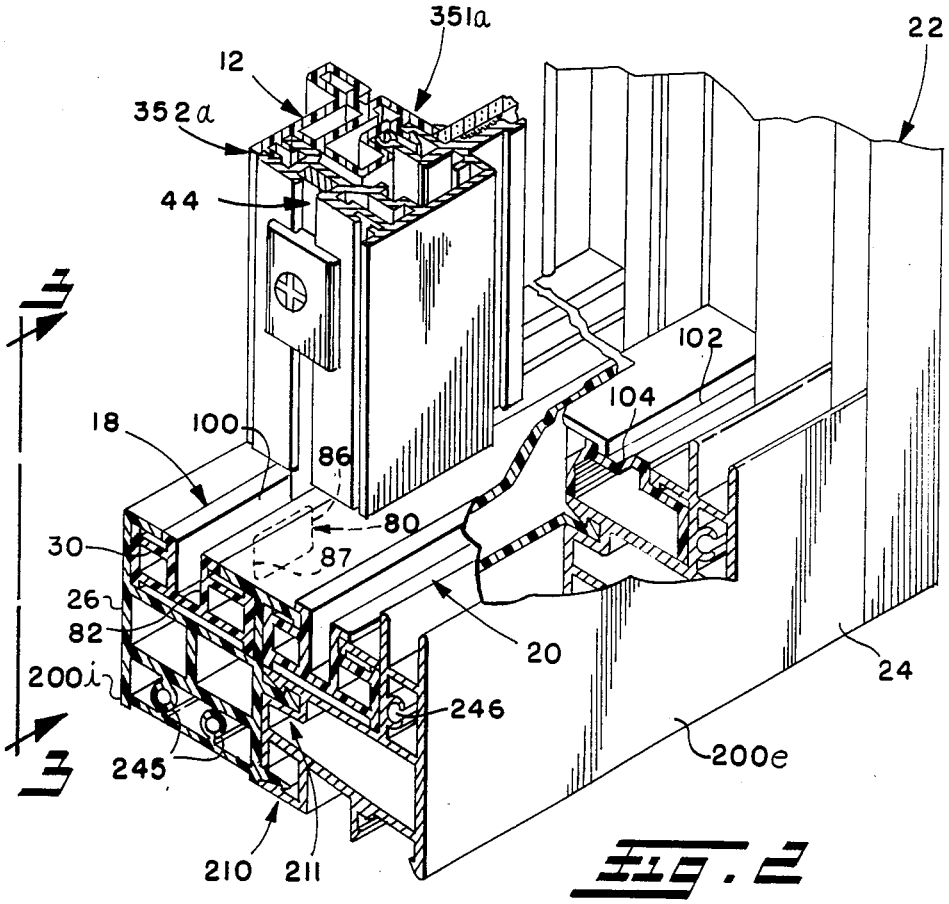
FIG. 2 is an enlarged partially sectioned view of a portion of the window of FIG. 1, and also viewed from the exterior of the window.
Figure 3:
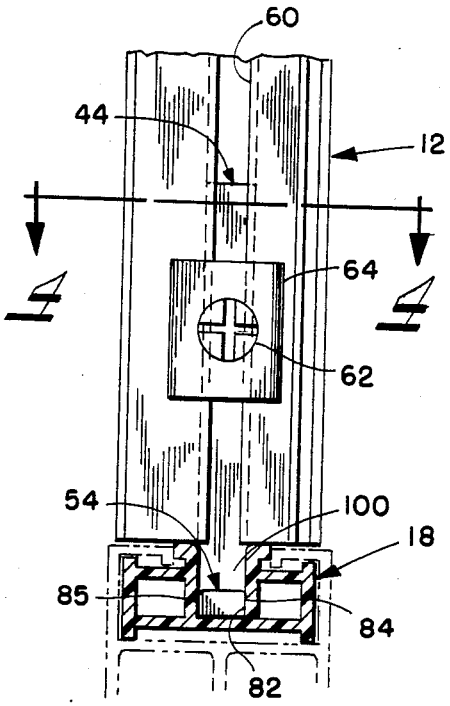
FIG. 3 is a view looking in the direction of arrows 3—3 of FIG. 2.

The window assembly 10 (FIG. 1) includes two sashes 12 and 14 which are horizontally slidable in tracks 18 and 20 (FIG. 2). As illustrated in FIG. 1, the sashes 12 and 14 slide horizontally, with the sash 14 mounted outside of the sash 12. The description which follows proceeds with respect to the wndow assembly as oriented in FIG. 1. However, it will be clear to those of ordinary skill in the art that the present invention could be embodied in other types of windows to achieve rotation of the entire window assembly approximately 90° from a closed condition. In the description that follows, the words "above", "below", "inside" and "outside" as well as "right" and "left" are used with respect to the orientation of the window assembly 10 shown in FIG. 1. This however is not intended to be limiting in any way and is merely for convenience of description.

The window assembly 10 includes tracks 18 and 20 which are mounted in a window frame 22. The window frame 22 includes an exterior facing portion 24 formed from an aluminum extrusion and an interior facing portion 26 made of vinyl. This construction provides a thermal barrier to reduce heat loss and sweating, especially since the vinyl tends not to sweat and in any event is less thermally conductive than is the metal. The frame 22 includes recesses 30 and 32 which mount and support the tracks 18 and 20, respectively. The recesses 30 and 32 are formed in the lower, horizontal member of the frame 22, and an identical pair of recesses (not shown) are formed in the upper member of the frame.

Figure 6:
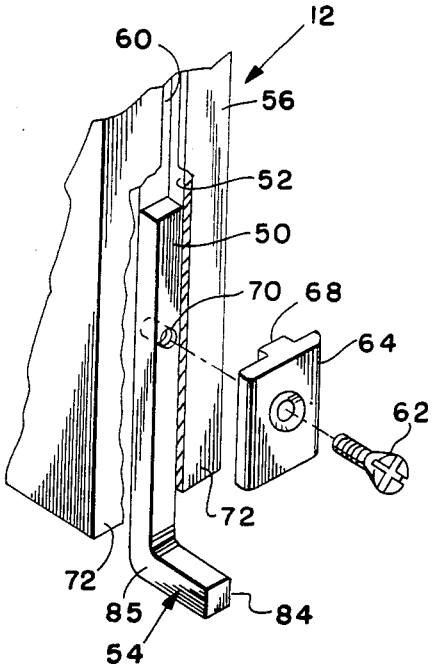
FIG. 6 is a partially sectioned and exploded view of a portion of the pivot mechanism of the window assembly of FIG. 1.

Each sash includes means for guiding its sliding movement in the frame 22. As illustrated in FIG. 1, there are two spring-loaded guide pins 36 and 38 which project downwardly and upwardly, respectively, from the rail of the sash 12 into the track 18. The pins 36 and 38 are essentially conventional, being spring biased to their extended positions and being retractable by means of appropriate buttons for purposes which will become clear from the discussion which follows. At the lefthand end of sash 14 there are a pair of identical pivot members 44 and 46. Inasmuch as the two pivot members are identical, only the pivot member 44 will be described in detail, it being understood that the description applies equally to the pivot member 46. The pivot member 44 (FIG. 6) includes a straight leg portion 50 which extends and fits snugly into a recess 52 formed in the vertical rail on the right side of sash 12. At the lower end portion of the pivot member 44 is a relatively short foot 54 which extends perpendicular to the straight leg portion 50 and in the plane of the glazing of the sash 12. The pivot member 44 is integrally formed from a piece of tooling steel which has a generally rectangular cross section. The width of the pivot member 44 is selected to slide easily within the tracks 18 or 20.

Means are provided for securing the pivot member 44 against unintended vertical movement with respect to the sash 12. In a preferred embodiment, the rail 56 of the sash 12 is formed, like the frame 22, of metal and plastic extrusions which are joined to each other. The recess 52 is formed in the metal portion of the rail 56 and extends its entire vertical length. In addition, the recess 52 is defined by the metal walls of the rail 56 which also define an outwardly opening slot 60. The pivot member 44 is secured in the recess 52 by means of a retaining bolt 62 and positioning and pivot pin locking pad 64. The pad 64 is formed of a relatively hard synthetic material such as a plastic material, e.g. nylon or Celcon. The pad 64 is generally shaped like a rectangular solid with a projecting tab 68 which fits into the slot 60 snugly. The pivot member 44 includes a threaded passage 70 which receives the bolt 62. When the bolt 62 is passed through the pad 64 and tightened into the passage 70, the portions of the pad 64 which extend beyond the projecting tab 68 bear tightly against the outside surface 72 of the rail 56, while the projecting tab 68 prevents rotation of the pad 64. Therefore, by tightening the bolt 62 it is possible to draw the leg portion 50 and the pad 64 toward each other to clamp the pivot member 44 against the walls of the rail 56 and into the desired position in the recess 52.

The foot 54 of the pivot member 44 preferably does not support the sash 12. Rather, a slider/glide pad assembly at all four corners, i.e. both top and bottom of the sash, supports the weight for easy sliding movement. The foot also slides in the track 18 and helps stabilize the side-to-side movement of the window during horizontal movement. Additionally, the corners of the foot 18 are slightly rounded, or at least not sharp, so that they do not dig into the vinyl extrusion track 18.

The window assembly 10 is designed so that the sashes 12 and 14 not only may slide in a plane defined by the upper and lower tracks in which they slide and parallel to the plane of their glazing for conventional opening and closing of the window assembly, but also the sashes 12 and 14 may individually be pivoted out of their plane of sliding movement so that both sides of the glazing of each sash may be easily cleaned from one side of a wall on which the window assembly is installed. The present invention not only makes pivoting a simple operation, it also stabilizes the sash when pivoted so that it does not twist diagonally in the window frame or fall out of the frame during pivoting movement and while in a pivoted condition. To this end, openings 80 are formed in a vertical sidewall 82 of the track 18. The openings 80 have a vertical dimension the same as or slightly larger than the vertical dimension of the foot 54 (FIG. 6) of the pivot member 44 and the two openings are in vertical alignment with each other, one being formed in the exterior vertical sidewall of the track 18 and the other in alignment therewith in the track which supports the top of the sash 12.

Figure 5:
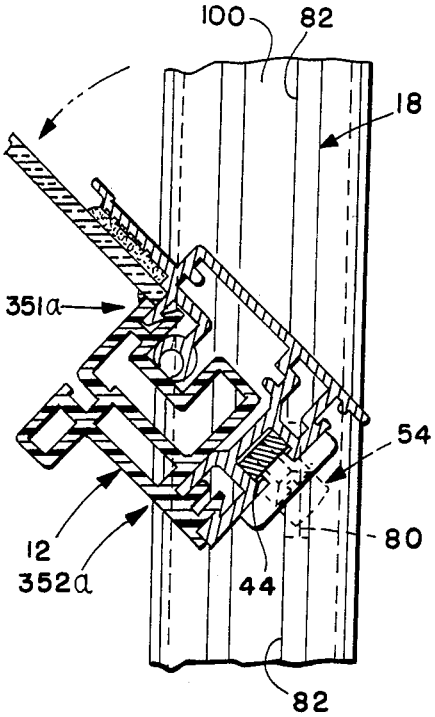
FIG. 5 is a view generally similar to FIG. 4 but showing the window assembly partially pivoted for cleaning.
Figure 4:
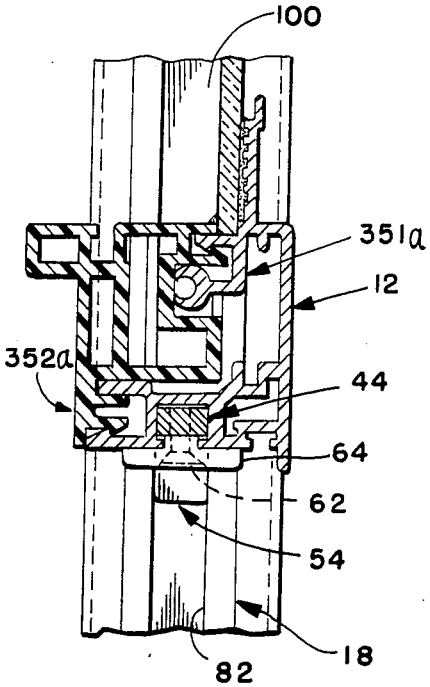
FIG. 4 is a view looking in the direction of arrows 4—4 of FIG. 3.

To pivot the sash 12 inward for cleaning, the sash is first slid along the track 18 until the foot 54 and the foot of the corresponding pivot member 46 extending upward from the top of the sash are in alignment with the respective openings 80 in the tracks in which they slide. Then, the retractable pins 36 and 38 are manually retracted so that they are free of contact with their respective tracks. Thereafter, the edge of the sash 12 from which the pins 36 and 38 extend is pulled inward while the opposite edge of the sash pivots about an axis defined by the leg portions 50 of the pivot members 44 and 46. As the pivot members 44 and 46 rotate, the feet 54 project into the openings 80 as shown in FIG. 5. Of course, if the window had not first been slid into proper alignment with the openings 80, the feet would bind against the sidewall 82 of the respective tracks 18 thereby preventing the window sash from being pivoted into the room while unsecured, i.e., when the feet are not aligned and/or in the respective openings 80.

Moreover, when the sash is properly aligned, and the feet do rotate into and through the openings 80, the feet serve to stabilize the pivoted open window, preventing it from rotating catercorner in the frame and falling out. This is so because the side faces 84 and 85 of the feet 44 engage the ends 86 and 87 of the openings 80. This prevents twisting of the sash while it is pivoted out of its usual plane of sliding movement and thus assures that the pivoting will be only about the axis defined by the pivot members 49 and 46.

In addition, it should be noted that the tracks 18 and 20 may be formed with a change in profile along their axial length which serves to limit the extent to which the sash may be slid in one direction. For example, the lefthand portion (as seen in the exterior view shown in FIG. 1) of the tracks 18 and 20 may have a rectangular slot 100 through which the foot 54 of the pivot member 44 (FIG. 6) slides easily. On the other hand, the righthand portion of the tracks may have a profile with a slot 102 which is narrower than the slot 100. The slot 102 will easily accommodate sliding of the retractable pins 36 and 38 therethrough, but is too small to allow the foot 54 to enter. By selecting the length of the righthand portion of the tracks 18 and 20 to be slightly longer than the distance between the righthand edge of the frame 22 and the pivot member 44 of the lefthand sash 12, the righthand portion of the track 18 will limit the distance through which the sash may be slid, thereby preventing the sash from being banged into the lefthand edge of the window frame.

Although the description has proceeded with respect to the lower portion of the window frame 22, the upper portion is essentially the same, and the description applies equally thereto. There is, however, one exception. To facilitate pivoting of the sash 14 inward for cleaning both sides of it, the window frame 22 forms an opening which is shorter for the outer sash 14 than for the inner sash 12. The bottom edges of the two sashes are level with each other, however the upper edge of the outer sash 14 is lower than the upper edge of the inner sash 12. In this way, the weatherstripping or the like associated with the outer sash does not contact the top of the window frame as the window is pivoted inward. In addition the openings 80 associated with the track 20 are spaced to the right (as viewed in FIG. 1) of the openings 80 in the track 18. This allows both sashes 12 and 14 to be pivoted simultaneously into the building in which the window assembly 10 is installed.

As a further feature of the present invention, the righthand portion (as seen in FIG. 1) of the tracks 18 and 20 may be provided with inclined or beveled surfaces 104 which slant in a direction to facilitate returning of the windows from their pivoted position to their normal position. To further this end, the pins 36 and 38 may be provided with beveled end surfaces 106 and 108. When pressed against the window frame 22 while pivoting the window back to its normal position, the inclined surface tends to retract the spring-loaded pins. The beveled surfaces on the tracks 18 and 20 further cooperate with the beveled surfaces on the pins 36 and 38 to ease the return of the window sashes to their usual position.

Thus, it will be appreciated that the invention may be used in connection with horizontally sliding windows in which one, two, three or even more sashes can slide generally in a horizontal fashion relative to the window frame. The sliding sash(es) will function in the usual sliding manner to enable opening or closing of the window. However, with the sash moved to the appropriate position for rotation for cleaning purposes, for example, i.e. with the feet aligned with respective openings in the upper and lower tracks, the buttons may be operated to withdraw the retractable pins and the window may be pivoted about a generally vertical axis. During such pivoting the feet hold the window in place and prevent the same from falling out, as has been described in detail above. More than one window may be pivoted open for cleaning at a time, if desired. After cleaning, for example, the pivoted open window may be moved back into closed position fully aligned with the appropriate tracks and slides for further horizontal sliding movement in usual manner. Therefore, the invention improves efficiency and facility vis-a-vis window cleaning, for example, while also improving the overall safety of operation since the window is held rather securely in place during normal sliding operation, during pivoting, and while pivoted in the open condition.

Figure 7:
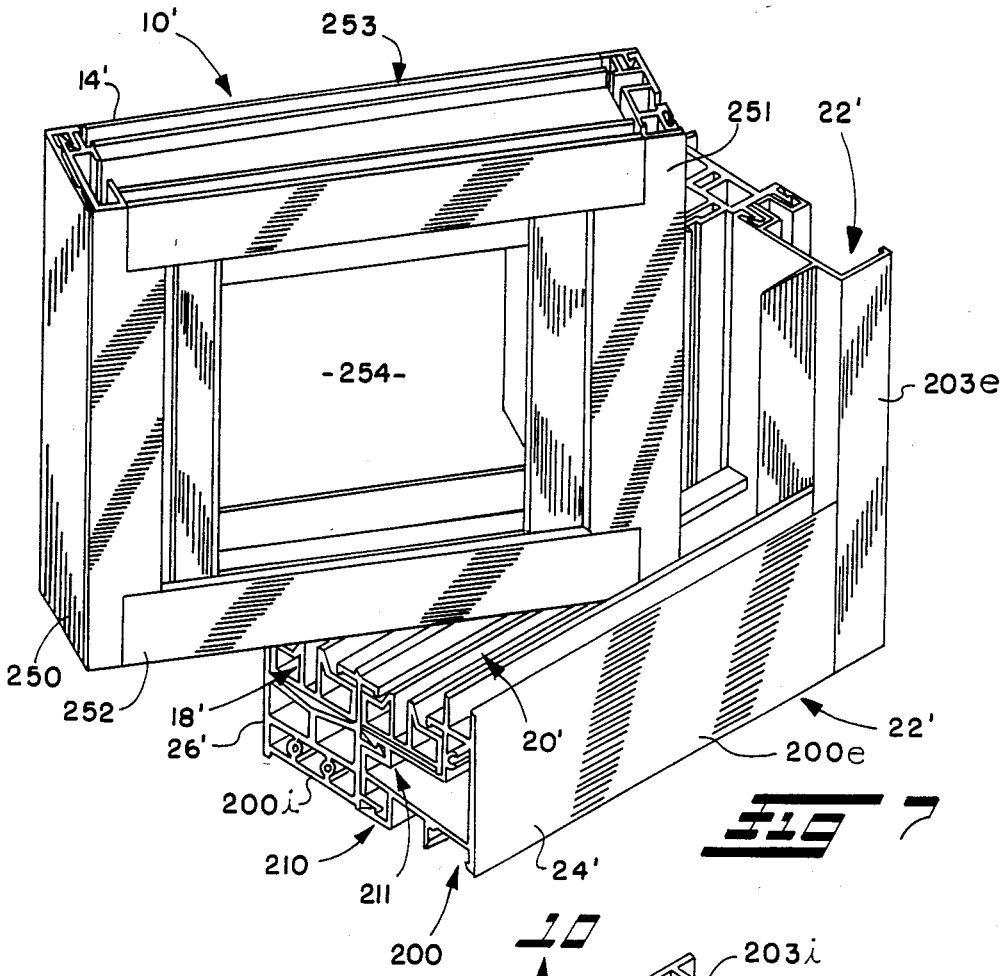
FIG. 7 is a fragmentary isometric view, partly in section, of a horizontal sliding window according to the present invention.

Turning now, to FIGS. 7–10, the manner in which the aluminum exterior and vinyl interior portions of a horizontal sliding window 10' (primed reference numerals refer to parts similar to those identified by unprimed reference numerals in FIG. 1–6) is illustrated. The window frame 22' includes the exterior and interior portions 24', 26' made, for example, respectively of aluminum extrusions and vinyl extrusions. More particularly, window frame 22' is formed of a sill 200, a head 201, and left and right jambs 202 and 203. Exterior frame portion 24' is composed four separate alumimun extrusions, including a sill 200*e*, a head 201*e*, and left and right jambs 202*e* and 203*e*. The interior frame portion 26' is composed of four vinyl extusions including a sill 200*i*, head 201*i*, and left and right jambs 202*i* and 203*i*. Although the various portions of the frame 22' preferably are made of aluminum and vinyl, other materials having similar characteristics to achieve the desired strength, rigidity and weatherability, etc. with respect to the exterior portion 24' and the thermal insulation, aestetics, and other characteristics of the interior frame portion 26' may be employed. It is noted that the sash 14' of the window assembly 10' also is formed of an aluminum exterior portion and a vinyl interior portion, as is shown in FIGS. 2, 5 and 7.

Figure 10:
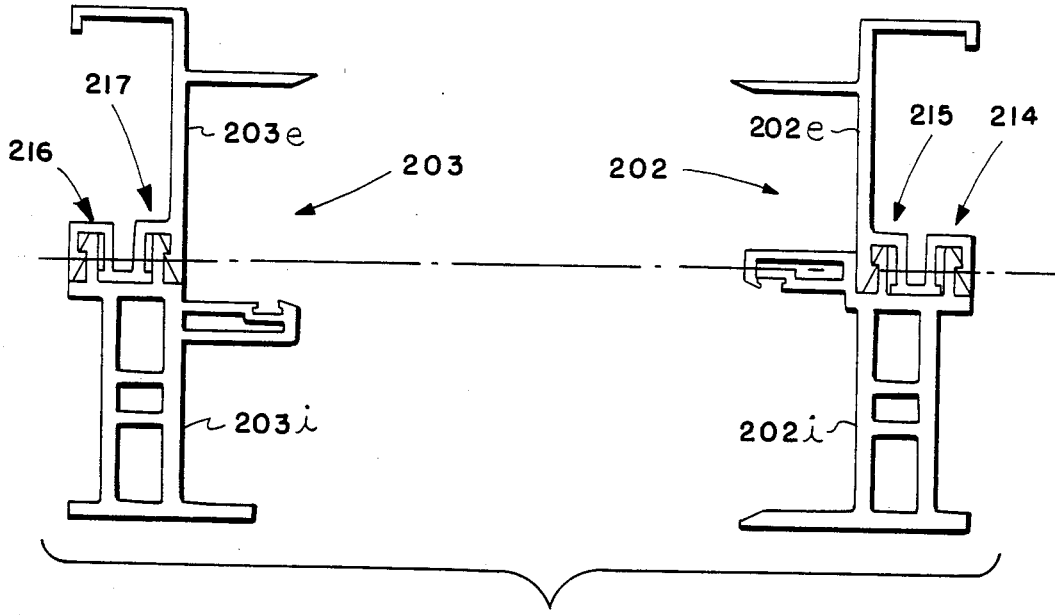
FIG. 10 is a section view of the left and right jamb assemblies for the window in FIG. 7, looking generally in the direction of the arrows 10—10 of FIG. 8.

The sill exterior 200*e* and the sill interior 200*i* are secured by two pairs of interlocking barb lock mechanisms 210, 211. Similarly, the exterior and interior portions 201*e*, 201*i* of the window head 201 are secured to each other by a pair of interlocking barb lock mechanisms 212, 213; and a pair of barb lock mechanisms 214–217 also are employed to lock the exterior and interior portions of the left and right jambs 202, 203, as seen in FIG. 10. Ordinarily, window frame 22' is assembled by first locking together the exterior and interior portions of the sill and also locking together the interior and exterior portions of each of the other parts of the frame thus providing for composite parts, for example, a composite sill having a secured, locked together exterior 200*e* and interior 200*i*, the composite head, and the composite jambs.

Figure 9:
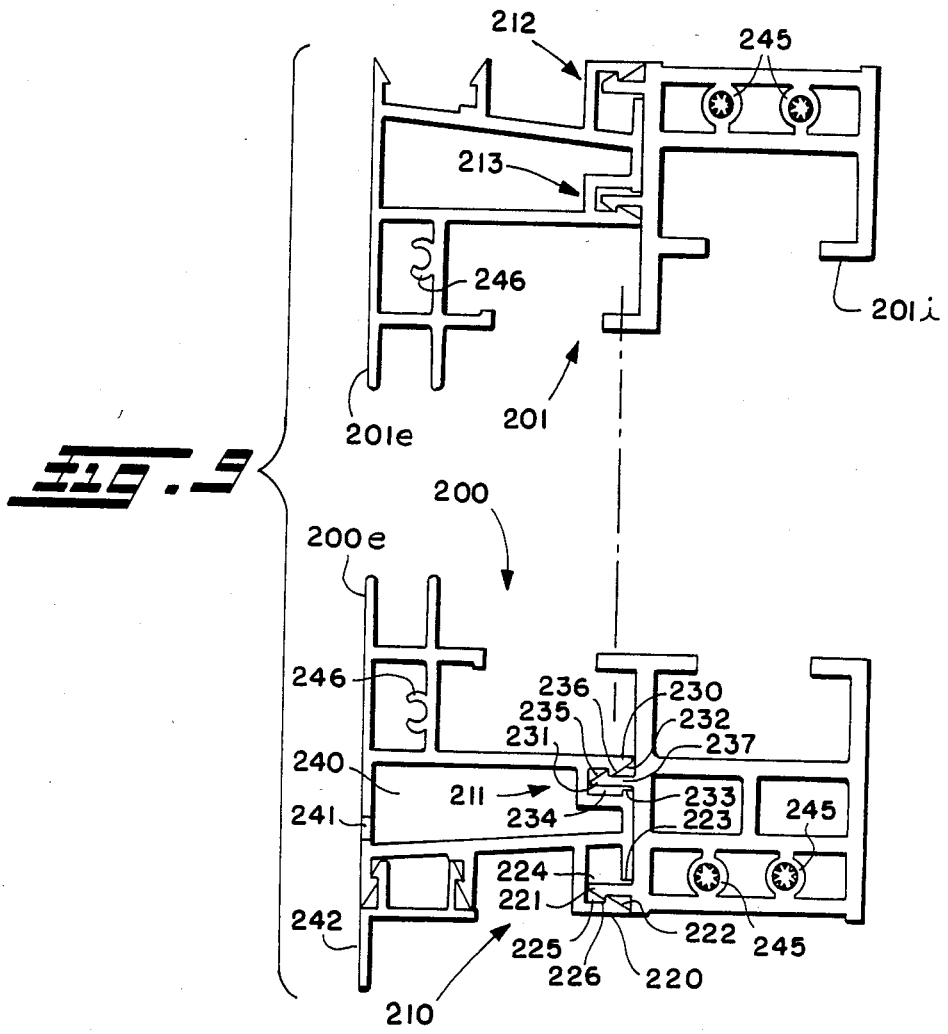
FIG. 9 is a section view of the sill and head for the window of FIG. 7, looking generally in the direction of the arrows 9—9 of FIG. 8.

Referring to FIG. 9 in particular, the lock 210 includes an aluminum barb 220 and a vinyl barb 221 shown already securely locked together. Preferably the aluminum extrusion 200*e*, part of which includes the barb 220, has adequate space between the sloped surface 222 of the barb 220 and the opposing wall surface 223 to provide a clearance space for inserting the vinyl barb 221 to the position illustrated. Since the barb 220 is of aluminum, it is relatively rigid compared to the relatively more resilient vinyl barb 221. The extrusion 200*e* also preferably has adequate space 224 within which the vinyl barb 221 may bend during the course of insertion to the locked position shown. The vinyl barb 221 has a leading sloped surface 225, which preferably slides along the aluminum sloped surface 222 during insertion of the vinyl barb into the space 224, in any event during the relative movement of the aluminum and vinyl barbs, to achieve the positive lock therebetween due to the interengaged flat surfaces generally designated 226. Furthermore, the dimensions of the barbs 220, 221 and the various other clearances provided in the lock mechanism 210, including in particular the space provided between the surface 222 and the wall 223, are such that the barb 221 may be resiliently deformed during insertion into the space 224, on the one hand, and assured to be placed into locked engagement shown at 226 due to the action of the wall 223 against the stem 227 of the barb 221. Thus, during such insertion, the surface 225 slides along the surface 222 as the stem 227 tends to distort resiliently, and after full insertion of the barb 221 has been achieved, the wall 223 assures that the barb is urged into the locked position with the lock surfaces 226 interengaged.

The lock mechanism 211 includes aluminum and vinyl locking barbs 230, 231, sloped surface 232, wall 233, space 234, surface 235, interengaged lock surfaces 236, and resilient stem 237, all of which correspond generally in form and function to the components 220–227, respectively, described above with reference to the lock mechanism 210.

Various lock mechanisms 212–217 for the other portions of the window frame 22' are similar to those described above with reference to the lock mechanism 210, 211 illustrated in FIG. 9. Preferably in all instances there is a pair of lock mechanisms used to lock each respective pair of members forming a given sill, head, or jamb in order to balance forces encountered by the respective resilient vinyl barb members (the aluminum barb members ordinarily being relatively more rigid than the vinyl ones), thus minimizing actual stresses and strains during insertion and locked holding together of the respective extrusions. That the two resilient barbs of the two lock mechanisms, e.g. 210, 211, ordinarily bend in opposite directions during locking, further assures force balancing and secure retention of the composite parts, namely the metal and vinyl components of a given frame (or sash) member.

The aluminum sill extrusion 200*e* has a sloped chamber 240 the purpose of which is to conduct any water that has condensed therein or has leaked therein to away from the vinyl toward respective drain openings 241. A vinyl cap 242 extending along the bottom of the sill may be provided in the manner illustrated secured to the extrusion 200*e* to provide additional weatherproofing and draftiness when the window is installed.

Figure 8:
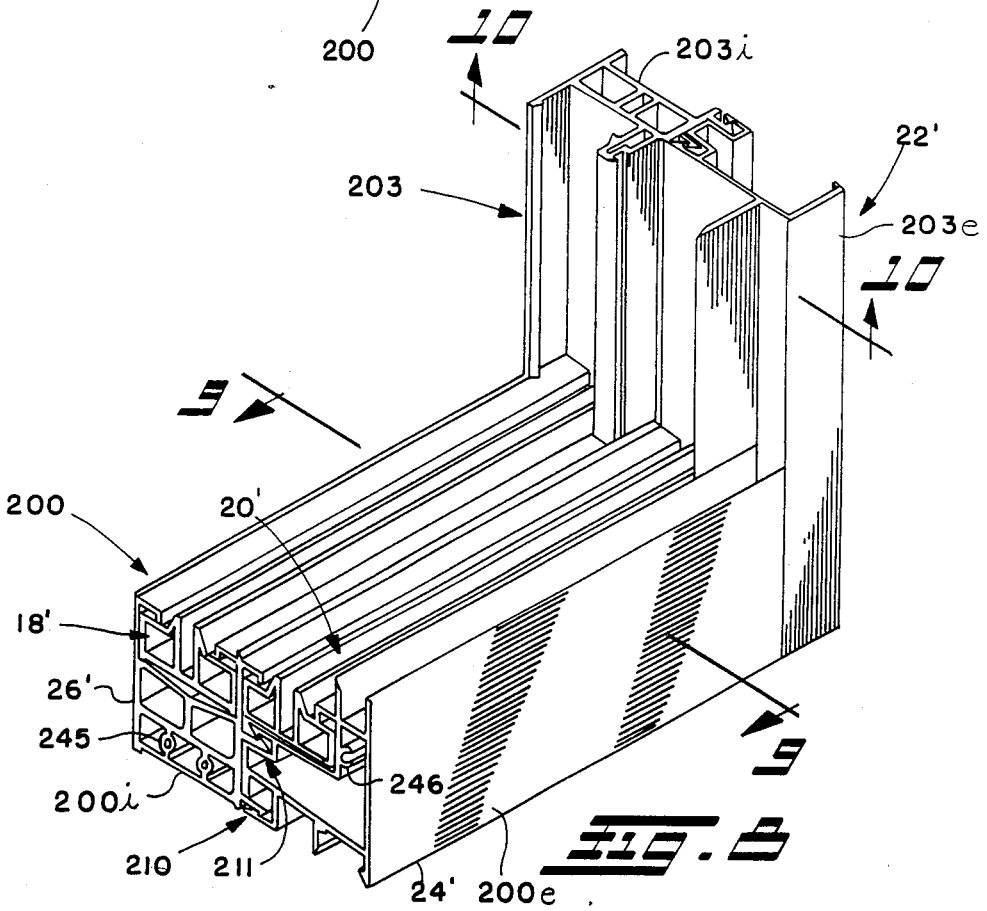
FIG. 8 is a fragmentary isometric view, partly in section, of the sill and jamb portions of FIG. 7.

After the composite sill, head and jambs have been separately assembled, the same are assemblied to complete the frame 22'. For example, as is seen in FIGS. 7 and 8, the sill (and the head as well) are placed with the respective ends thereof in abutment with the side of respective jambs. Holes would be drilled through the respective jambs in alignment with the screw thread receiving openings 245 in the vinyl extrusions and the partial screw thread receiving ends 246 in the aluminum extrusions. Respective screws then could be inserted through the respective drilled holes for self-tapping connection in the respective openings 245, 246.

The stiles 250, 251 and rails 252, 253, which together with the glass 254 form the sash 14' (FIG. 7) also preferably are formed of the composite aluminum exterior parts and vinyl interior parts that are locked together using the technique of the barbs, such as those used in the lock 210, as is seen, for example, in the upper exposed portion of FIG. 7. The other sash (not shown in FIG. 7) also would be similarly formed.

With the foregoing in mind, it will be appreciated that the horizontal sliding window assembly 10, 10' of FIGS. 1–10 has excellent thermal insulating characteristics, avoids sweating on the inside, permits improved aestetics on the inside, has excellent durability and strength, especially due to the aluminum exterior portion, etc. as were mentioned above. These effects are accomplished due to the materials used and due to the dead air spaces provided in the various members and between respective members of a composite part of the window. The ability securely to lock together a metal portion and a plastic portion of a window to provide a resulting product with such advantageous characteristics is an important achievement of the invention and the strength of securement and facility with which such securement can be effected further increase the importance of such achievement of the invention.

The features of the invention also may be employed in windows other than the horizontal sliding type. These may include, for example, picture windows in which none of the sashes slides or opens, double hung windows in which one or more of the sashes slide vertically, and so on. In FIGS. 11–17 is illustrated an example of the invention employed in the various parts of a double hung window.

Figure 11:
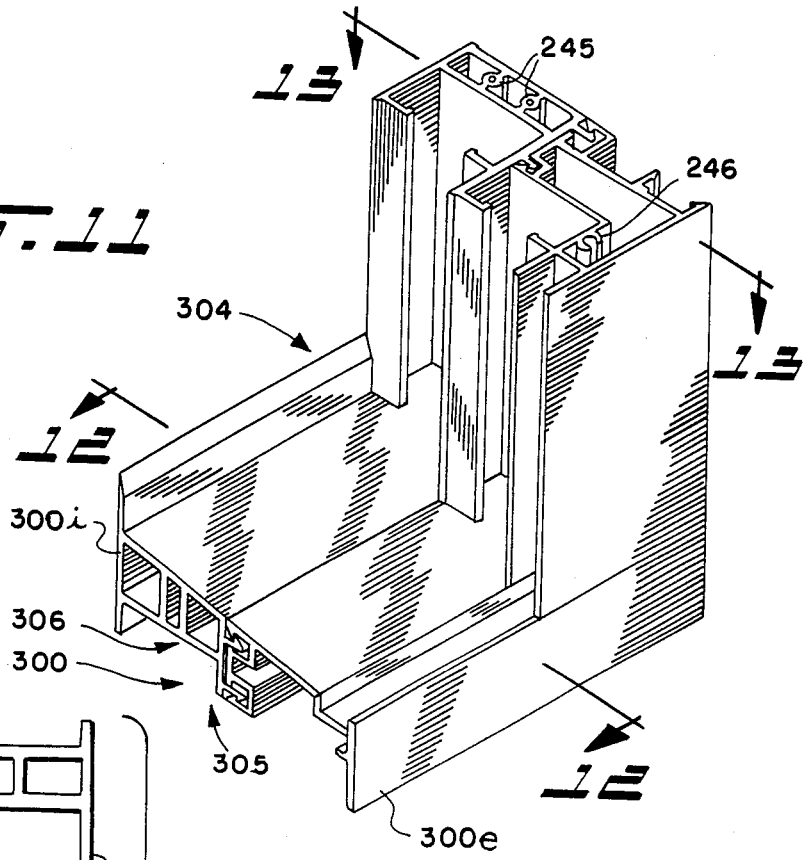
FIG. 11 is a fragmentary isometric view, partly in section, of the sill and jamb of a double hung window according to the invention.
Figure 12:
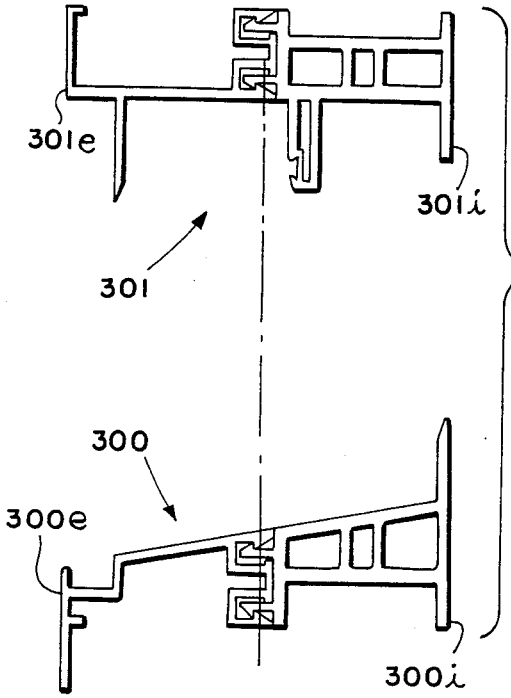
FIG. 12 is a section view of the sill and head of the double hung window looking generally in the direction of the arrows 12—12 of FIG. 11.
Figure 13:
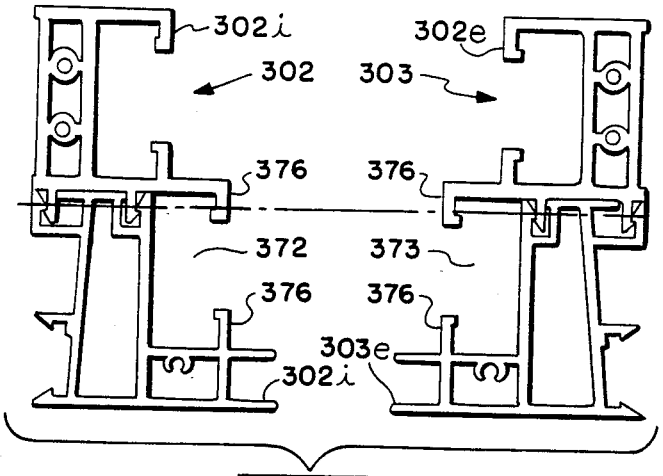
FIG. 13 is a section view of the left and right jamp assemblies for the double hung window looking generally in the direction of the arrows 13—13 of FIG. 11.

In FIGS. 11, 12 and 13 are illustrated the sill 300, head 301, and left and right jambs 302, 303 for such a double hung window. Each of the sill, head and jambs is formed, as above, as a composite of an aluminum exterior portion identified by a reference numeral with a suffix "e" such as the sill exterior 300*e*, and a vinyl interior portion identified by a reference numeral with a suffix "i", such as the sill interior 300*i* (FIGS. 11 and 12). Each of the aluminum exterior and vinyl interior portions forming each such part of the window frame, a portion of which is shown assemblied at 304 in FIG. 11, is securely locked using a pair of barb lock mechanisms 305, 306, which are similar in form and function to the pair of barb lock mechanism 210, 211 (FIG. 9) of the sill 200, for example. Moreover, the left and right hand jambs are attached to the sill and head of the window frame by drilling holes through the sill and head and fastening screws therethrough for self-tapping into openings 245, 246 (FIG. 11).

Figure 14:
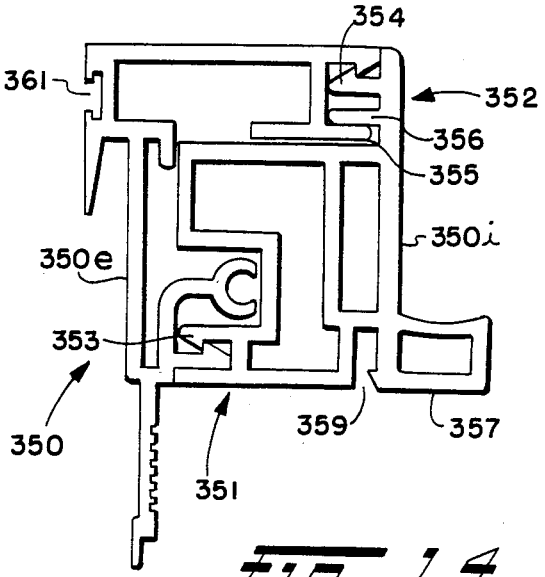
FIGS. 14, 15 and 16 are section views of the top sash rail assembly, inside rail lock side assembly and small stile assembly used to form the smaller sash of a double hung window, frame portions of which are illustrated in FIGS. 11, 12 and 13.
Figure 15:
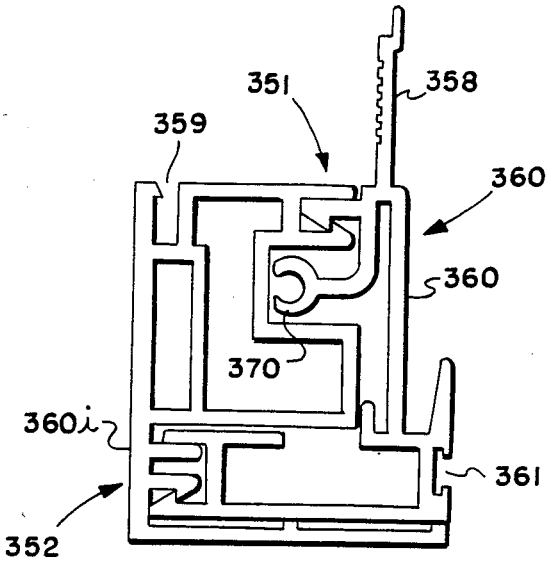
Figure 16:
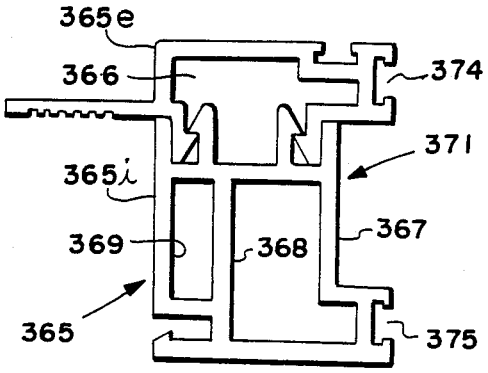
Figure 17:
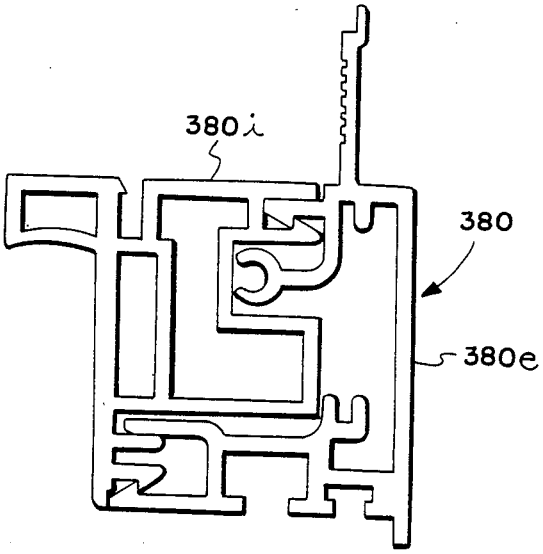
FIGS. 17 and 18 are section views of the pull rail assembly and large sash stile assembly used in the large sash of such double hung window.

As is seen in FIG. 13, the double hung window has a larger inner sash and a relatively smaller exterior sash. The various parts used according to the invention to form such sashes are illustrated in cross section in FIGS. 14–18. The actual dimensions of the glass in the respective sashes may be the same; the difference in space between the vinyl jambs 302*i*, 303*i* and the space between the aluminum jambs 302*e*, 303*e* being made up by the size of the respective sash stiles. For the top sash, FIG. 14 shows the top rail assembly 350 composed of an aluminum exterior 350*e* and a vinyl interior 350*i* secured together by a pair of barb lock mechanisms 351, 352 arranged as aforesaid for balanced force application between the pair of vinyl barbs 353, 354. (Similar barb lock mechanisms are also designated 351*a*, 352*a* in FIGS. 2, 5 and 6.) Associated with the barb lock mechanism 352 are a pair of interlocking surfaces 355 (of aluminum) and 356 (of vinyl) assuring proper alignment, forced balancing, and positioning of the respective barbs in the manner illustrated in FIG. 14. The top sash rail assembly 350 also includes a lifting rail 357 at which force can be applied manually to slide the sash in the window frame. An aluminum surface 358 is provided against which the glass pane can be glazed, and a rubber, vinyl or other material glazing strip may be applied over the glass and secured in place at the barbed opening 359 in the vinyl rail portion 350*i*. For the top sash, there is also a bottom rail assembly 360, shown in FIG. 15. The bottom rail assembly 360 includes an aluminum exterior extrusion portion 360*e* and a vinyl interior extusion portion 360*i*, which are substantially the same in shape and function as the aluminum and vinyl portions of the top sash rail assembly 350. A slot 361 in the aluminum extrusion may be provided as illustrated to receive and to retain a weather-stripping material. The small stile assembly 365 shown in FIG. 16 is employed at each of the opposite vertical sides of the upper sash for the double hung window. Such small stile assembly includes an aluminum exterior portion 365*e* and a vinyl interior portion 365*i*, the two being locked securely by the barb lock mechanism generally designated 366 being of a type similar to that described above, for example, with reference to the lock mechanism 210. Holes may be drilled through the walls 367, 368, 369 of the small stile assembly to pass a screw therethrough for threaded engagement to the self-tappable openings 370 in the respective rails, 350, 360. A recessed zone 371 in the small stile assembly is provided to slide along a plastic slide rail (not shown) that would be inserted in the respective openings 372, 373 in the left and right jambs illustrated in FIG. 13. Such slide rails may be T or I shaped having a flange portion that fits in the respective openings 372, 373 and a stem or second flange portion for mating with the recess 371 in those stiles. Weather-stripping may be provided at the respective openings 374, 375 (FIG. 16) in the respective stiles to provide a weather seal at the respective opposed jamb surfaces 376.

Figure 18:
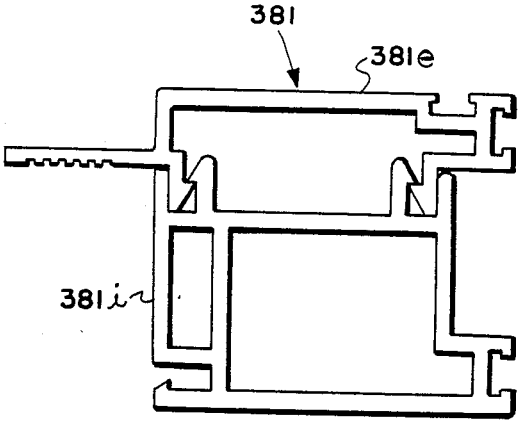

The larger sash i.e., that slideable on the vinyl extrusion portions of the jamb for the double hung window, includes a top rail assembly (not shown but similar to the bottom rail assembly 360 of FIG. 15), a bottom rail assembly 380 (shown in FIG. 17), and a pair of large sash stile assemblies 381 respectively at opposite vertical sides of the sash (as shown in FIG. 18). Each of such rail and stile assemblies 380, 381 is composed of an aluminum exterior designated by the suffix "e" and a vinyl interior portion designated by the suffix "i" to form a composite member or assembly using barb lock mechanisms, such as those described above and illustrated in FIGS. 17 and 18, and the respective assemblies are secured together by screws as aforesaid. Moreover, appropriate weather-stripping and glazing may be provided in the manner described above.

In view of the foregoing, it will be appreciated that the various features of the invention accomplished by the securely locked together vinyl and aluminum parts of which each portion of the window is composed are achieved in double hung and various types of other windows as well.

I claim:

1. a window assembly comprising a frame and at least one sash, at least one of said frame and sash including as composite structure first and second elongate, generally parallel members of dissimilar materials assembled to form such frame or sash, and resilient lock means for securing said members together in positive locked parallel relation, at least one of said members being relatively rigid and at least one of said members being of lower thermal conductivity than the other, said resilient lock means comprising a pair of interlocking barb protrusions, each on a respective member and each having a sloped surface to slide against the sloped surface of the other barbed protrusion during locking of said members together and a stop surface cooperative with the stop surface of said other member to prevent separation of said members, each barb protrusion being located at an end of a stem connected with a respective member, the stem of at least one of each respective pair of the barb protrusions being resiliently deflectable during locking of said members, and force applying means proximate to the resiliently defectable stem of said at least one of each respective pair of the barb protrusions for maintaining the integrity of the interlock of each respective pair of the barb protrusions.

2. The assembly of claim 1, wherein said first member is relatively rigid and said barb protrusion thereof is relatively rigid, said second member is relatively resilient and said second barb protrusion thereof is relatively resilient and has a stem which deforms resiliently during sliding engagement of said sloped surfaces during locking and resiliently returns to a relatively undeformed position after said sloped durfaces have been slid relatively past each other, thereby to position said stop surfaces in confronting relation in locked position.

3. The assembly of claim 2, wherein said relatively rigid member includes a limited size opening to receive said resilient barb protrusion during insertion and locking.

4. The assembly of claim 3, said limited size opening including a limit surface which forms part of said force applying means and which is disposed to impede withdrawing of said resilient barb protrusion from locked engagement with said rigid bar protrusion.

5. The assembly of claim 2, wherein said resilient lock means comprises a pair of the same positioned on said members generally to balance the force of resilient bending moment in said resilient barb protrusions.

6. The assembly of claim 5, wherein the sloped surfaces of said resilient barb protrusions face in opposite directions, whereby said resilient barb protrusions bend resiliently in opposite directions during locking.

7. The assembly of claim 6, said relatively rigid member comprising aluminum and said relatively lower thermal conductivity member comprising vinyl.

8. The assembly of claim 7, wherein both said frame and sash are formed of said composite structure.

9. The assembly of claim 8, said sash comprising plural sashes.

10. The assembly of claim 9, wherein at least one of said sashes is pivotable.

11. The assembly of claim 10, said frame including track means for defining a plane of sliding movement of said sash, pivot means disposed at least partly on said sash and defining an axis of pivoting movement of said sash out of said plane of sliding movement and stabilizing means connected with said sash for preventing sliding movement of said sash when said sash is pivoted out of said plane of sliding movement, said stabilizing means including a foot extending normal to said pivot axis, parallel to said plane of sliding movement, and received in said track means and openings in said track means for receiving said foot upon pivoting of said sash.

12. The assembly of claim 9, wherein at least one of said sashes is slidable.

13. The assembly of claim 12, said frame and sashes comprising a double hung window.

* * * * *